US006902827B2

(12) United States Patent
Kelly et al.

(10) Patent No.: US 6,902,827 B2
(45) Date of Patent: Jun. 7, 2005

(54) PROCESS FOR THE ELECTRODEPOSITION OF LOW STRESS NICKEL-MANGANESE ALLOYS

(75) Inventors: James John Kelly, Oakland, CA (US); Steven Howard Goods, Livermore, CA (US); Nancy Yuan-Chi Yang, Lafayette, CA (US); Charles Henry Cadden, Danville, CA (US)

(73) Assignee: Sandia National Laboratories, Livermore, CA (US)

( * ) Notice: Subject to any disclaimer, the term of this patent is extended or adjusted under 35 U.S.C. 154(b) by 469 days.

(21) Appl. No.: 10/222,534

(22) Filed: Aug. 15, 2002

(65) Prior Publication Data

US 2004/0031691 A1 Feb. 19, 2004

(51) Int. Cl.[7] ..... B32B 15/01; C25D 5/14; C25D 5/18

(52) U.S. Cl. ..... 428/635; 428/680; 428/935; 205/104; 205/176; 205/181

(58) Field of Search ..... 428/635, 680, 428/681, 655, 935, 596; 205/104, 176, 181, 255

(56) References Cited

U.S. PATENT DOCUMENTS

| | | | | |
|---|---|---|---|---|
| 4,461,680 A | | 7/1984 | Lashmore | |
| 4,652,348 A | | 3/1987 | Yahalom et al. | |
| H000543 H | * | 11/1988 | Chen et al. | 428/635 |
| 4,869,971 A | | 9/1989 | Nee et al. | |
| 5,156,729 A | * | 10/1992 | Mahrus et al. | 205/104 |
| 5,158,653 A | | 10/1992 | Lashmore et al. | |
| 5,190,637 A | | 3/1993 | Guckel | |
| 5,268,235 A | | 12/1993 | Lashmore et al. | |
| 5,320,719 A | | 6/1994 | Lasbmore et al. | |
| 5,378,583 A | | 1/1995 | Guckel et al. | |
| 5,527,445 A | * | 6/1996 | Palumbo et al. | 205/103 |
| 6,547,944 B2 | * | 4/2003 | Schreiber et al. | 205/96 |
| 2003/0134142 A1 | * | 7/2003 | Ivey et al. | 428/646 |

OTHER PUBLICATIONS

Atanassov et al. (1996), "Electrodeposition and Properties of Nickel–Manganese Layers," *Surface and Coatings Technology 78*:144–149.

Dini et al. (1978), "On the High Temperature Ductility Properties of Electrodeposited Sulfamate Nickel," *Plating and Surface Finishing 65*(2):36–40.

Malone (1987), "New Developments in Electroformed Nickel–Based Structural Alloys," *Plating and Surface Finishing 74*(1):50–56.

Stephenson, Jr. (1966), "Development and Utilization of a High Strength Alloy for Electroforming," *Plating 53*(2):183–192.

Wearmouth et al. (1979), "Electroforming with Heat–Resistant, Sulfur–Hardened Nickel," *Plating and Surface Finishing 66*(10):53–57.

* cited by examiner

*Primary Examiner*—John J. Zimmerman
(74) *Attorney, Agent, or Firm*—Reed Intellectual Property Law Group

(57) ABSTRACT

A process for electrodepositing a low stress nickel-manganese multilayer alloy on an electrically conductive substrate is provided. The process includes the steps of immersing the substrate in an electrodeposition solution containing a nickel salt and a manganese salt and repeatedly passing an electric current through an immersed surface of the substrate. The electric current is alternately pulsed for predetermined durations between a first electrical current that is effective to electrodeposit nickel and a second electrical current that is effective to electrodeposit nickel and manganese. A multilayered alloy having adjacent layers of nickel and a nickel-manganese alloy on the immersed surface of the substrate is thereby produced. The resulting multilayered alloy exhibits low internal stress, high strength and ductility, and high strength retention upon exposure to heat.

21 Claims, 6 Drawing Sheets

PROCESS FOR THE ELECTRODEPOSITION OF LOW STRESS NICKEL-MANGANESE ALLOYS

ACKNOWLEDGEMENT OF GOVERNMENT SUPPORT

The United States Government has rights in this invention pursuant to Contract No. DE-AC04-94AL85000 between the United States Department of Energy and Sandia Corporation for the operation of Sandia National Laboratories.

TECHNICAL FIELD

The present invention relates generally to electrodeposition processes and specifically to electrodeposition processes that are suitable for use in the fabrication of LIGA microparts.

BACKGROUND OF THE INVENTION

Electrodeposited metals and alloys are customarily used to fabricate microparts patterned with electrodeposited metals and alloys, using processes such as LIGA, and other commonly known patterning techniques. The production of micro-scale metal parts via LIGA (German acronym for lithography, electroplating, and molding) is a multi-step process requiring mask production, synchrotron exposure of the polymethylmethacrylate (PMMA) substrate (typically PMMA bonded to a metallized silicon wafer or a solid metal plate), development of the PMMA, electroplating to fill the cavities left within the PMMA mold, lapping, and final dissolution of the remaining PMMA. This technology is described in U.S. Pat. No. 5,378,583.

In order for the microparts to have proper mechanical functionality in the microsystems in which they are often used, e.g., sensing or actuating devices, the electrodeposited materials must have high strength (≧80 MPa) and display good ductility. Ideally, these materials should possess through-thickness uniformity (of microstructure and composition) and retention of ductility after thermal exposure. Furthermore, the plating process should be performable at or near room temperature. Unique to microparts patterned using the LIGA process, is the requirement that the above properties and material characteristics be realized in high aspect ratio (>10), thick-section deposits (200 $\mu$m to 2 mm).

Various electrodeposited elemental metal or alloy thick films that are known in the art may meet some, but not all, of the criteria indicated above. For example, nickel-cobalt alloys are readily electrodeposited and exhibit high yield strengths. However, as cobalt deposition rates are highly dependent on local mass transport conditions, electrodeposition through a thick mold results in compositional nonuniformities, such as non-uniform cobalt concentration. These nonuniformities result in significant variations in the hardness and strength of the micropart, which renders the micropart useless for structural applications typical of microsystem designs. While variations in cobalt concentration may be minimized using extremely low average deposition rates, the use of lower deposition rates results in impractically long electrodeposition times and intractably high film stresses.

Another way to achieve high-strength electrodeposited material is by using additives such as saccharin in the plating bath to produce fine grain sized nickel. However, the addition of saccharin results in the incorporation of sulfur in the electrodeposited nickel. Sulfur concentrations of hundreds of wt. ppm are produced, even at the lowest practical saccharin additions to the bath. While the resulting electrodeposit possesses high strength, good ductility, and good through-thickness compositional and property uniformity, the high sulfur content renders it susceptible to catastrophic embrittlement upon exposure to even modestly elevated temperatures. As a result, sulfur-containing electrodeposited materials may not be used for any application in which temperature excursions of 200° C. may occur.

Nickel-manganese alloys, are described by W. B. Stephenson Jr. (1966) *Plating*, 53 (2):183. The principal difficulty with these alloys is that under DC plating conditions, high residual stresses develop as the thickness of the deposit increases. These stresses often lead to delamination of the deposited film from the deposition substrate. At a minimum, one of the consequences of this delamination is the failure of the part to deposit satisfactorily. More importantly, such delamination is likely to cause the failure of the entire deposition process, through either the stress-induced failure of the substrate or the inability to planarize the deposited parts to a final target thickness. Further, these stresses increase rapidly as the manganese concentration in the deposit increases. Even a few tenths of a percent increase in manganese concentration have been shown sufficient to cause stresses in excess of 100 MPa.

There is, therefore, a need in the art for a technique that provides an electrodeposited material having the requisite high strength, good ductility, good through-thickness composition, resistance to high temperature embrittlement, property uniformity and low plating stress. The present invention addresses this need.

SUMMARY OF THE INVENTION

It is an object of the present invention to provide an electrodeposition process that may be carried out at or near ambient temperatures.

It is another object of the invention to provide an electrodeposition process that results in a deposited alloy having low plating stress.

It is yet another object of the invention to provide an electrodeposition process that results in through-thickness compositional uniformity.

It is still a further object of the invention to provide an electrodeposition process that is capable of depositing a layered alloy having high as-plated strength.

It is still a further object of the invention to provide an electrodeposition process that is capable of depositing a layered alloy that does not exhibit a significant loss of strength and ductility after heat treatment.

It is yet another object of the invention to provide a layered alloy formed using the aforementioned electrodeposition process.

It is still another object of the invention to provide a micropart comprised of the aforementioned layered alloy.

Additional objects, advantages, and novel features of the invention will be set forth in part in the description that follows, and in part will become apparent to those skilled in the art upon examination of the following, or may be learned by practice of the invention.

In one embodiment of the invention, a process is provided for electrodepositing a layered nickel and nickel-manganese alloy onto a metal substrate. The process involves first providing an electrolyte containing a nickel salt and a manganese salt. Next, a substrate upon which nickel and manganese may be electrodeposited is provided, and at least a portion of the substrate is immersed in the electrolyte. An alternately pulsed electric current is then passed through the immersed portion of the substrate. The electric current is alternately pulsed for predetermined durations between a first electrical current that is effective to electrodeposit nickel and a second electrical current that is effective to electrodeposit both nickel and manganese. The alternating pulses of electric current thereby produce a layered alloy having adjacent layers of nickel and a nickel-manganese alloy on the immersed surface of the substrate. In this process, the concentration of manganese is lower than the concentration of nickel in the electrolyte.

In another embodiment of the invention, a multilayered alloy comprising a plurality of alternating layers of nickel and a nickel-manganese alloy is provided. The alternating layers may be of the same thickness or of different thicknesses. Each of the layers has a thickness of from approximately 3 Å to approximately 20 nm.

In yet a further embodiment of the invention, a micropart comprised of the aforementioned alloy, and fabricated using the above-discussed method, is provided. The microparts display an as-plated strength of greater than 800 MPa, and display low loss of strength and improved ductility after heat treatment.

DETAILED DESCRIPTION OF INVENTION

Figure 1A:
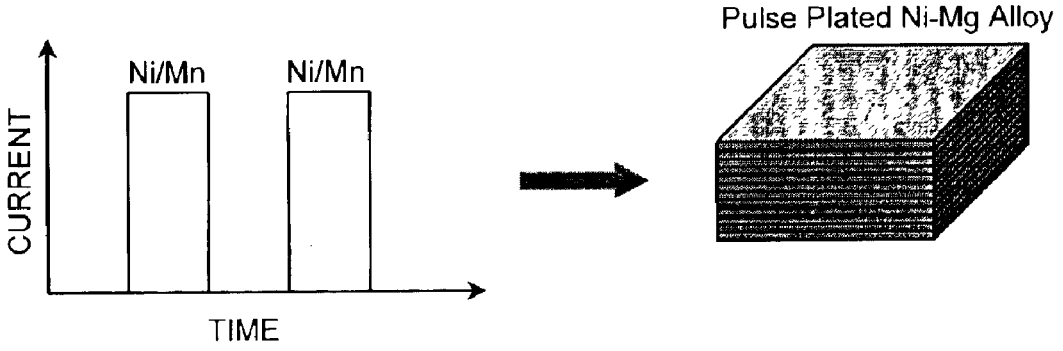
FIG. 1A Prior Art
FIGS. 1A and 1B are graphical representations of a pulse plated nickel-manganese alloy of uniform composition, and of the pulse plated multilayered nickel and nickel-manganese alloy of the invention.

Overview and Definitions:

Before describing the present invention in detail, it is to be understood that unless otherwise indicated this invention is not limited to specific micropart materials or manufacturing processes, as such may vary. It is also to be understood that the terminology used herein is for the purpose of describing particular embodiments only, and is not intended to be limiting.

It must be noted that, as used herein, the singular forms "a," "an," and "the" include plural referents unless the context clearly dictates otherwise. Thus, for example, "a micropart" encompasses not only a single micropart but also two or more microparts, and the like.

In describing and claiming the present invention, the following terminology will be used in accordance with the definitions set out below.

The term "aspect ratio" is used herein in its conventional sense to refer to the ratio of an object's height to its width (or diameter). High aspect ratio structures are thus prepared using molds (such as LIGA molds) having voids, or recesses, that are extremely narrow relative to their height.

The terms "microfeature" and "microscale feature" are used interchangeably to refer to a feature of micrometer or submicrometer dimensions. The feature may be a protrusion or a recess, e.g., a ridge, pillar, channel, chamber, or the like, wherein the length, width, height, and/or depth of the feature is on the order of approximately 0.1 $\mu$m to 1000 $\mu$m, generally about 0.5 $\mu$m to 500 $\mu$m, and most typically about 1 $\mu$m to 200 $\mu$m.

The terms "internal plating stress" and "internal stress" refer to the tendency of a material to curl or deform, causing it to peel away from the substrate onto which it is deposited. Tensile and compressive stresses result in concave and convex delamination, respectively. The internal stress of a deposit may be characterized using conventional methods such as the bent strip method and commercially available testing equipment such a Model 683 deposit stress analyzer, available from Specialty Testing and Development Co., Pa.

The Novel Low Stress Plating Technique:

The present invention is directed to a technique for moderating the plating induced stresses found in conventional electroplated nickel-manganese alloys (such as that produced via continuous DC [direct current] plating). The technique utilizes pulse plating to produce a layered material consisting of alternating layers of high-strength, highly stressed nickel-manganese alloy and layers of lower strength pure nickel. Such alternating layers can be achieved because the deposition of manganese is dependent on the applied current density, so that at higher current densities more manganese is codeposited. In the method of the invention, the electrolyte contains a low concentration of manganese relative to the concentration of nickel, so that while a significant amount of manganese can be codeposited at high currents, almost no codeposition occurs at low currents. By depositing the alloy in a layered fashion with alternating nickel and nickel-manganese layers, deformation accommodation by the softer nickel layers reduces plating stresses, and a high strength nickel-manganese alloy with lower plating-induced stress results.

Figure 1B:
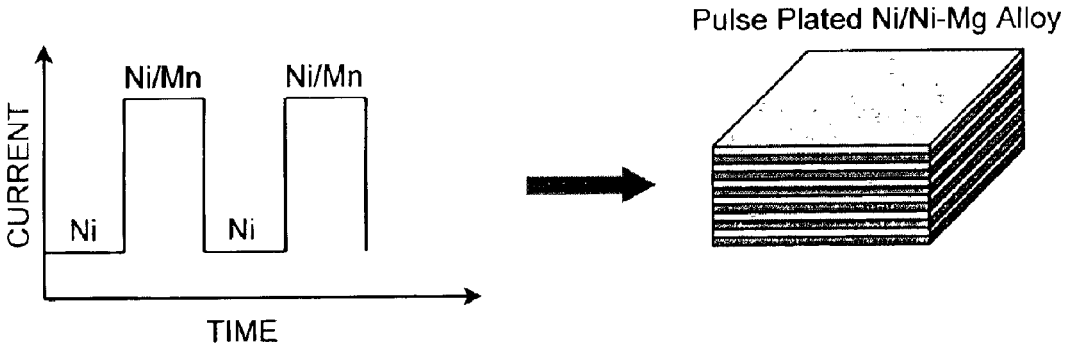

Previous pulse plating attempts using nickel and manganese (e.g., Atanassov et al. (1996) *Surface and Coatings Technology* 78:144–149) focused on simply increasing the net manganese concentration over that achievable through conventional DC plating processes. In contrast, the instant invention focuses the use of low stress nickel layers to improve the plating characteristics of the plated alloy. FIGS. 1A and 1B schematically show the process of the invention in comparison to previous pulse plating efforts. In FIG. 1A the current was periodically turned off, during which time no deposition occurred. The net result was a deposit in which the manganese concentration did not vary. In FIG. 1B, which represents the method of the invention, the current is varied between a high value (which allows for the co-deposition of manganese along with nickel) and a lower, but finite value that permits the continued deposition of nickel only. In this way a true compositionally modulated layered alloy is realized in which the plating stresses of the nickel-manganese alloy are accommodated by the deformation of the low strength nickel layers.

The substrate on which the layered nickel-manganese/nickel alloy is deposited may be any electroplatable, i.e., conductive, surface. The substrate may be a metal substrate, metallized silicon or glass substrate. If a silicon wafer is utilized, metallic layers may be bonded to the surface of the wafer in order to provide conductive means or in order to create a "sacrificial" metal layer. The use of sacrificial metal layers to form movable microstructures is presented in U.S. Pat. No. 5,190,637 to Guckel et al. The metal layers can be deposited by any conventional method, i.e., thermal evaporation, electron beam, or sputtering.

The electrodeposition technique of the invention is specifically suited to the formation of microparts or microstructures on patterned electroplatable substrates. Suitable patterned substrates may be fabricated, for example, using the LIGA process or other micro-machining technologies. Such processes are disclosed, for example, in U.S. Pat. No. 5,378,583 to Guckel et al. A closely related process uses ultraviolet (UV) lithography with a thick film photoresist, such as SU-8, in place of X-ray lithography and a PMMA resist in the LIGA process. As known in the art, SU-8 is a negative, epoxy-type, near-UV photoresist formulation available from MicroChem Corporation in Newton, Mass., and is particularly useful for preparing features with very high aspect ratios (on the order of 20 or higher) using standard lithography equipment. See U.S. Pat. No. 4,882,245 to Gelorme et al. and Lorenz et al. (1998) "Mechanical Characterization of a New High-Aspect-Ratio near UV-photoresist," *Microelec. Engin.* 41/42:371–374. Those of skill in the art will appreciate that the exact type of substrate provided and/or patterning method used are not critical elements of the electrodeposition technique of the invention. All that is required is that the substrate be suitable for electrodeposition.

At least a portion of the substrate is immersed in an electrolyte solution that contains nickel and manganese salts. Suitable nickel and manganese salts are commercially available and will be well known to one of skill in the art. Examples of suitable salts include manganese chloride, manganese sulfamate, manganese sulfate, nickel sulfamate, nickel sulfate, and nickel chloride. The concentration of elemental nickel in the electrolyte will range from approximately 60 g/L to approximately 90 g/L, while the concentration of elemental manganese will range from approximately 0.1 g/L to approximately 5 g/L. It is noted that the concentration of nickel in the electrolyte is greater than the concentration of manganese. Preferred electrolyte solutions will contain concentrations of elemental nickel ranging from approximately 70 g/L to approximately 80 g/L and of elemental manganese ranging from approximately 0.5 g/L to approximately 3.0 g/L. In general, the concentration of nickel is approximately 20 to 160 times the concentration of manganese.

One advantage of the method of the invention is that it can be conducted at or near ambient temperatures, i.e., temperatures ranging from approximately 20° C. to approximately 35° C. Conducting the electrodeposition of the multilayered alloy at or near ambient temperatures reduces the likelihood of flaws in the microfeatures of microparts formed when the method is used to deposit the multilayered alloy in a LIGA or other patterned resist. When such LIGA resists are subjected to elevated temperatures, i.e., greater than 50° C., the polymeric material from which the resist is constructed may be subject to thermal damage that deforms or damages the microfeatures patterned in the resist. The present invention avoids these risks and allows for greatly enhanced microfeature formation and micropart replication.

As the electrodeposition of manganese is sensitive to temperature, it will be appreciated by those of skill in the art that the concentration of manganese utilized in the electrolyte solution is related to the temperature at which the electroplating is conducted. When the electrodeposition is carried out at higher temperatures, higher concentrations of manganese must be used. As lower concentrations of manganese are desirable in the electrolyte solution in order to form the nickel-only layers, it is preferred that the electrodeposition be carried out at temperatures ranging from approximately 25° C. to approximately 30° C.

The electrical current is applied using alternating pulses of two different current levels: a first current, ranging from approximately 1 mA/cm$^2$ to approximately 6 mA/cm$^2$, and a second current, ranging from approximately 12 mA/cm$^2$ to approximately 25 mA/cm$^2$. Preferably, the first current ranges from approximately 2 mA/cm$^2$ to approximately 5 mA/cm$^2$ and the second current ranges from approximately 15 mA/cm$^2$ to approximately 20 mA/cm$^2$. Galvanostatic or potentiostatic electrodeposition may be used. By alternating between the two current levels with each pulse, the present invention provides significant improvements of techniques used in the art where the electrical current is pulsed repeatedly at each level (e.g., U.S. Pat. No. 4,869,971 to Nee et al.).

It is noted that this process employs pulse plating to deposit low stress nickel layers in between the more highly stressed nickel-manganese layers by taking advantage of an appropriately low manganese concentration in the electrolyte solution. This is in contrast to methods used by others, wherein pulse plating is used to augment manganese levels, thereby resulting in higher strengths but higher stresses. It is noted that these stresses may be so high as to render the electrodeposit unusable in thick sections, characteristic of LIGA components, or so high as to crack or otherwise fail the mold. Other advantages are obtained by the method of the invention where the less noble element (manganese) is very dilute in the electrolyte compared to the more noble one (nickel), whereas in previous metal multilayer deposition processes it was the more noble element (e.g., copper) that was much more dilute in the electrolyte solution (as compared to the less noble one, e.g. nickel or cobalt). See for example, U.S. Pat. No. 4,652,348 to Yahlom et al.

The individual pulses of electrical current may last from approximately 0.01 second to approximately 10 seconds. The first and second levels of current may be applied in equal duration or may vary in duration so that the nickel layers are thinner or thicker than the manganese-nickel layers. Generally, the individual nickel layers will be thicker than the individual nickel-manganese layers.

Figure 2:
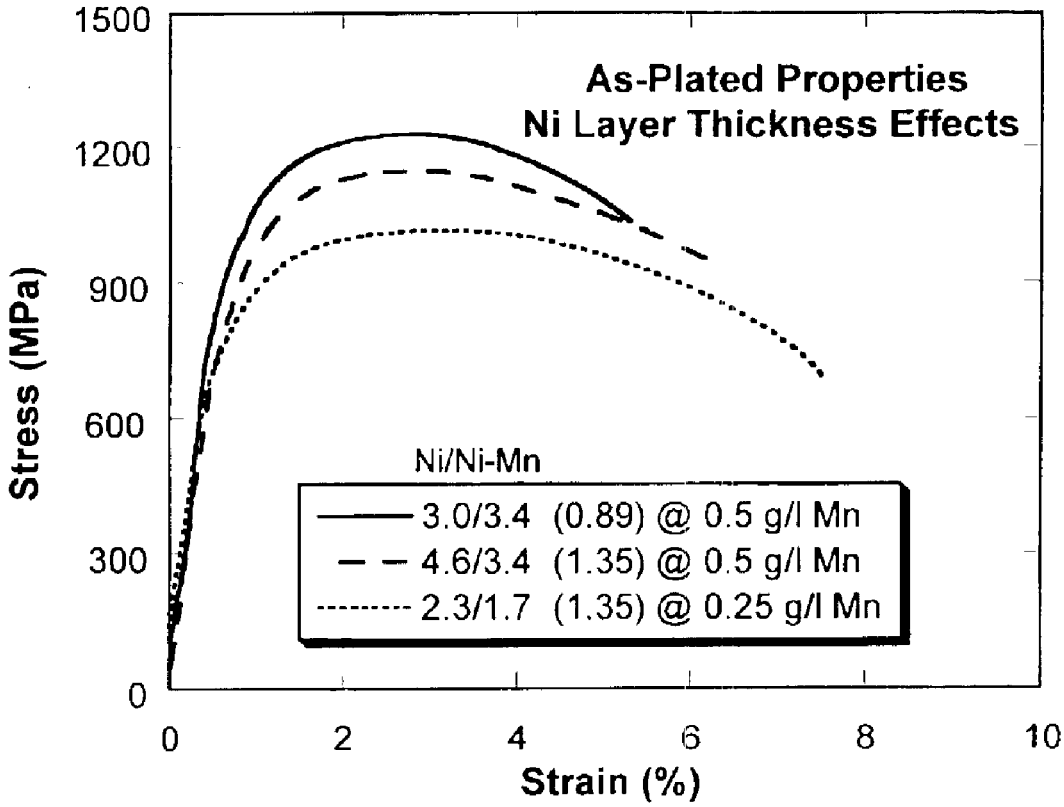
FIG. 2 graphically illustrates the as-plated properties of the three pulse plated multilayered nickel and nickel-manganese alloys discussed in Example 2.

The Novel Multilayered Alloy:

The multilayer alloy formed using the above-described technique is made up of a plurality of alternating layers of nickel and a nickel-manganese alloy. The alternating layers may be of the same or of differing thicknesses. Individual layers will range from approximately 3 Å to approximately 20 nm, with thicknesses ranging from approximately 1 nm to approximately 5 nm being more common. Total thickness of the deposited alloy can range from 200 $\mu$m to 2 mm, and the alloy is suitable for use in the fabrication of features having aspect ratios of 10 or higher. FIG. 2 graphically represents the as-plated strength properties for three different variations of the pulse plated multilayered nickel and nickel-manganese alloy.

Figure 3A:
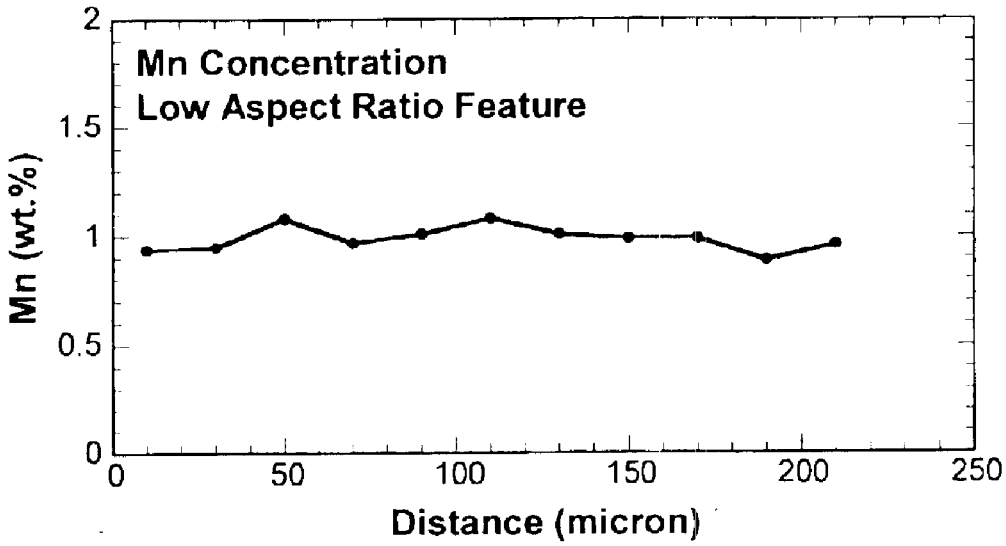
FIGS. 3A and 3B graphically illustrate the compositional uniformity of the pulse plated multilayered nickel and nickel-manganese alloy of the invention when used to form both low and high aspect ratio features.
Figure 3B:
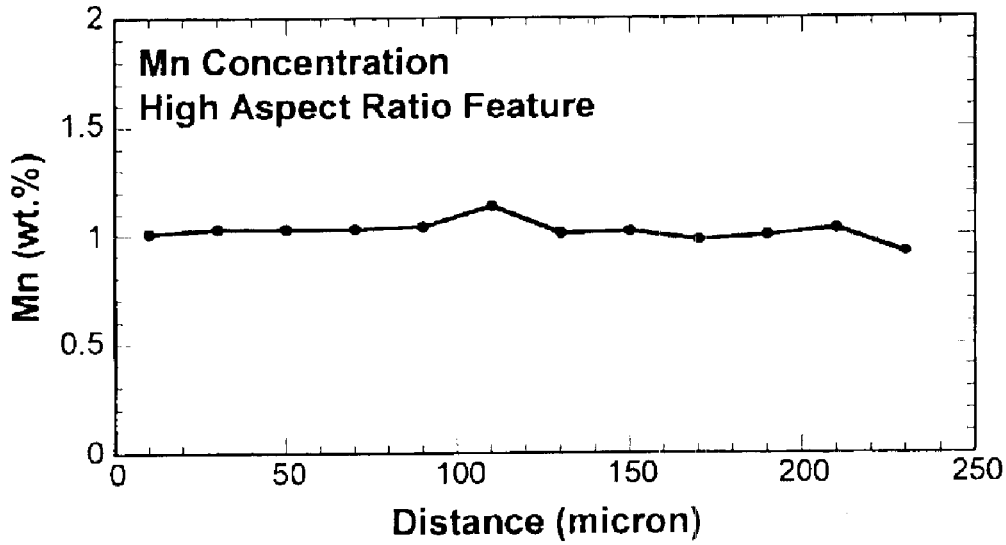

Unlike known cobalt-nickel alloys, the multilayered alloys of the invention exhibit high compositional uniformity. Variation in compositional uniformity for both high, i.e., greater than approximately 10, and low aspect ratio features is less than approximately 15%, with a variation of less than approximately 10% being more common. FIGS. 3A and 3B graphically illustrate the compositional uniformity of the multilayered nickel and nickel-manganese alloy of the invention when used to form both low and high aspect ratio features.

Figure 4:
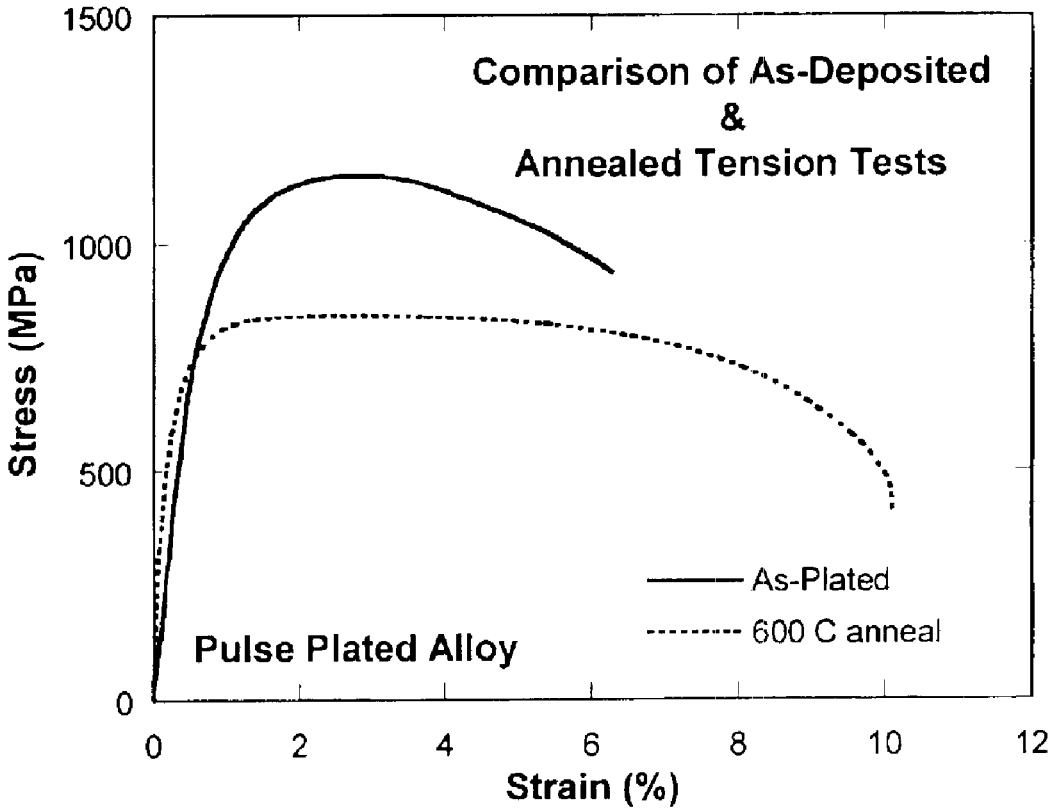
FIG. 4 graphically illustrates a comparison of the as-deposited and annealed tension test for a pulse plated multilayered nickel and nickel-manganese alloy of the invention.

Unlike high-strength nickel alloys formed using saccharin in the electrolyte solution, the multilayered alloy of the invention exhibits high ductility upon heating. The yield strength of the electrodeposited alloy is greater than approximately 900 MPa with greater than approximately 6% total ductility. For example, after heating at 600° C. for 1 hour, the alloy retains at least 85% of yield strength with an increase in ductility ranging from approximately 6% to approximately 10% of the as-plated ductility. FIG. 4 graphically illustrates a comparison of the "as plated" and annealed strength properties of the pulse plated multilayered nickel and nickel-manganese alloy of the invention.

Figure 5A:
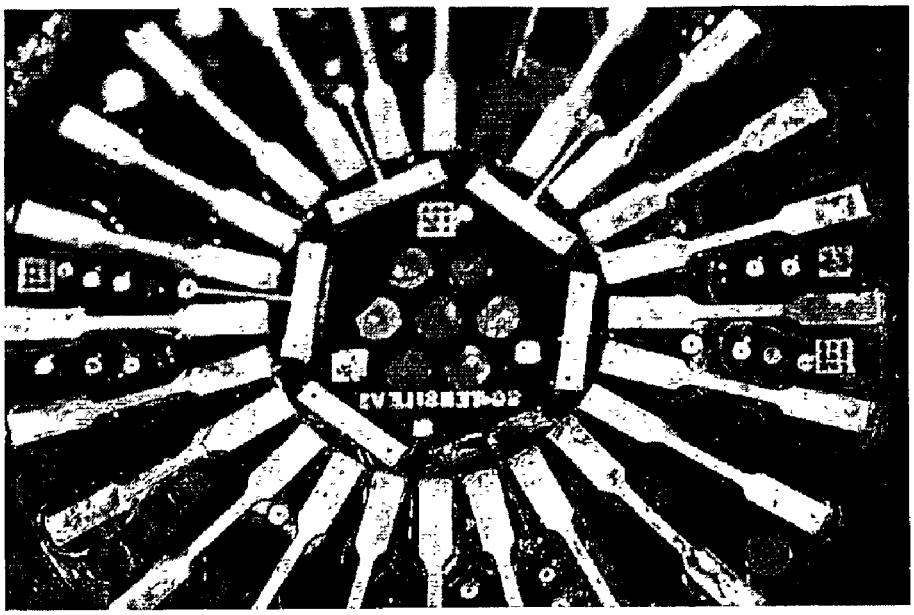
FIGS. 5A and 5B show the failure of a LIGA part mold resulting from excessively high stresses for DC-plated NiMn alloy. The NiMn part was deposited from a solution with 5 g/L Mn from a Ni sulfamate electrolyte at 15 mA/cm$^2$.
Figure 5B:
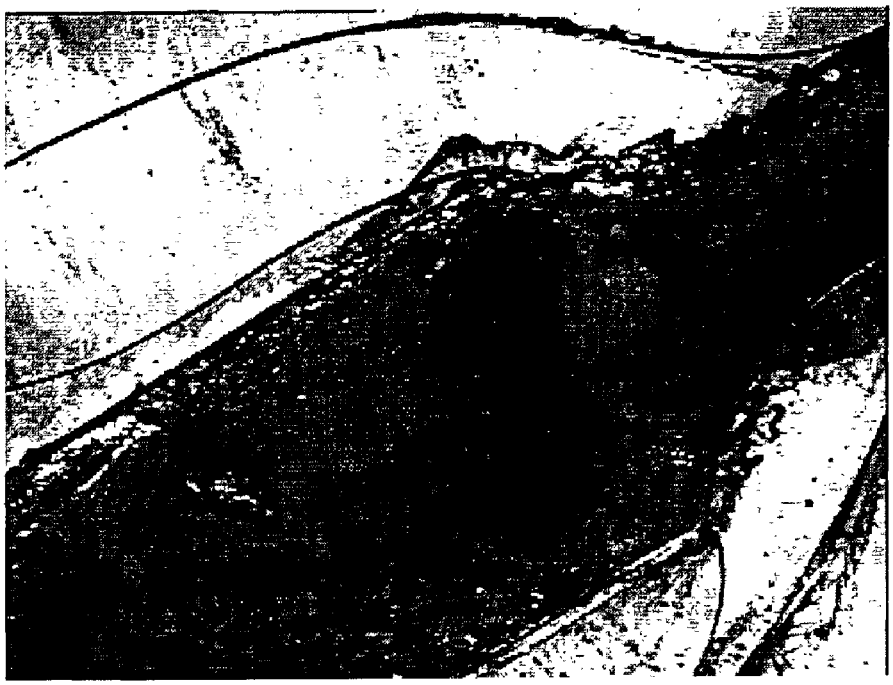

Such strength retention and ductility are similar to the strength and ductility displayed by known nickel-manganese alloys. As discussed above, known nickel-manganese alloys are subject to excessively high internal plating stresses that often result in failure to successfully form features in LIGA micropart molds. FIGS. 5A and 5B are photos depicting flawed microparts formed of a nickel-manganese alloy using a LIGA micropart mold. In contrast to known electroplated nickel-manganese alloys, however, the multilayered alloys of the invention exhibit internal plating stresses of less than approximately 100 MPa, with internal plating stresses of less than approximately 75 MPa being preferred and stresses of less than approximately 60 MPa being most preferred.

Figure 6A:
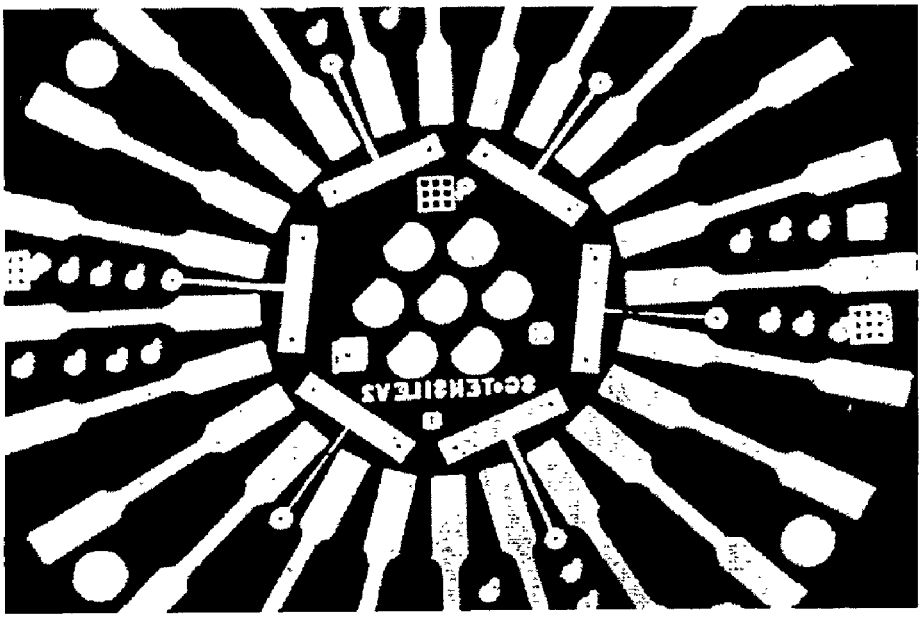
FIGS. 6A and 6B show a LIGA part mold as prepared in Example 1.
Figure 6B:
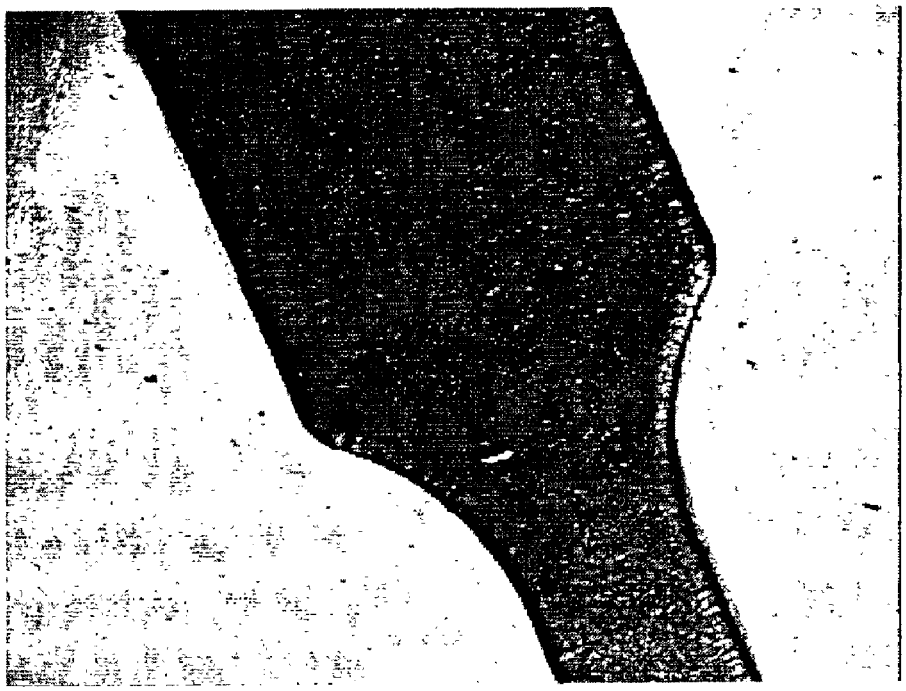

FIGS. 6A and 6B show successfully formed LIGA microparts made of the pulse plated multilayered nickel and nickel-manganese alloy of the invention.

Example 1

FIGS. 6A and 6B show microparts formed from an alloy that was pulse plated from a bath having 0.5 g/L Mn added as $MnCl_2$, 1.35 M Ni as nickel sulfamate, 30 g/L boric acid, and 0.2 g/L sodium dodecyl sulfate. The pH was 4.0 and the temperature was 28° C. On time and off time current densities of 15 and 3 mA/cm$^2$ were employed, respectively, while the on and off times were 0.667 and 2.9 sec, respectively. It is obvious that the quality of the plated material is much higher than that given by DC plating, as shown in FIGS. 5A and 5B. 100% of the parts were successfully deposited.

Example 2

Internal plating stress properties were determined for three different pulse plated multilayered nickel and nickel-manganese alloys, plated according to the process described in Example 1. These multilayered alloys were also subjected to stress testing. The compositional parameter for each of the alloys is presented in Table 1, and the results of the testing are graphically depicted in FIG. 2. In FIG. 2, Alloy 1 is represented by a broken line, Alloy 2 by a solid line, and Alloy 3 by a dotted line.

TABLE 1

| ALLOY | CONC. MN | CURRENT DENSITY 1 | CURRENT DENSITY 2 | PULSE DURATION 1 | PULSE DURATION 2 | THICKNESS NI LAYER | THICKNESS NI—MN LAYER |
|---|---|---|---|---|---|---|---|
| 1 | 0.5 g/L | 3 mA/cm$^2$ | 15 mA/cm | 4.4 sec | 0.667 sec | 4.6 nm | 3.4 nm |
| 2 | 0.5 g/L | 3 mA/cm$^2$ | 15 mA/cm | 2.9 sec | 0.667 sec | 3.0 nm | 3.4 nm |
| 3 | 0.25 g/L | 3 mA/cm$^2$ | 15 mA/cm | 2.2 sec | 0.333 sec | 2.3 nm | 1.7 nm |

Some of the many uses of the substrates that are electroplated by the methods described herein, include the manufacture of micro-scale chem/bio detectors, portable or miniaturized medical diagnostic equipment, DNA analysis equipment, optical switches and related equipment, inertial sensing devices, and other miniaturized devices.

It is to be understood that while the invention has been described in conjunction with the preferred specific embodiments thereof, the foregoing description and the examples that follow are intended to illustrate and not limit the scope of the invention. Other aspects, advantages, and modifications within the scope of the invention will be apparent to those skilled in the art to which the invention pertains.

All patents, patent applications, and publications mentioned herein are hereby incorporated by reference in their entireties.

EXPERIMENTAL

The following examples are put forth so as to provide those of ordinary skill in the art with a complete disclosure and description of how to prepare and use the compositions disclosed and claimed herein. Efforts have been made to ensure accuracy with respect to numbers (e.g., amounts, temperatures, rates, times, etc.) but some errors and deviations should be accounted for. Unless indicated otherwise, parts are parts by weight, temperature is in degrees Celsius (° C.), and pressure is at or near atmospheric. Additionally, all starting materials were obtained commercially or synthesized using known procedures.

Mechanical testing of the LIGA fabricated specimens was performed in an Instron Model 5848 Microtester. All specimens were tested at room temperature at an initial strain rate of 5×10–4 sec$^{-1}$. Strain was measured using a non-contacting EIR Model LE-01 laser extensometer. Load was measured using an Instron 1 kN load cell.

Example 3

As-plated and annealed stress testing was conducted on the multilayered alloy prepared in Example 1. The results of the testing are depicted in FIG. 4. The first sample, represented by a broken line, was pulse plated as described in Example 1. As indicated in FIG. 4, as-plated strength in excess of 900 MPa was observed. The presence of the soft, low stress nickel layers did not seriously compromise the post-annealing strength retention. As shown in FIG. 4, after a 1 hour 600° C. heat treatment, there was only a 15% loss in yield strength. This is in direct contrast to a 75% loss in yield strength that a nickel-only deposit would be expected to suffer upon similar heat treatment.

We claim:

1. A process for electroplating a layered nickel and nickel-manganese alloy onto a metal substrate comprising:

(a) providing an electrolyte solution containing a nickel salt and a manganese salt;

(b) providing a conductive substrate suitable for nickel and manganese electrodeposition;

(c) immersing at least a portion of the substrate in the electrolyte solution; and (d) passing an electric current through the immersed surface of the substrate, the electric current being alternately pulsed for predetermined durations between a first electrical current that is effective to electrodeposit nickel and a second electrical current that is effective to electrodeposit nickel and manganese, thereby producing a multilayered alloy having adjacent layers of nickel and a nickel-manganese alloy on the immersed surface of the substrate, wherein the concentration of manganese in the electrolyte solution is lower than the concentration of nickel.

2. The process of claim 1 wherein the concentration of manganese in the electrolyte solution ranges from approximately 0.1 g/L to approximately 5 g/L.

3. The process of claim 1, wherein step (d) is conducted at a temperature ranging from approximately 20° C. to approximately 35° C.

4. The process of claim 1, wherein the first electrical current ranges from approximately 1 $mA/cm^2$ to approximately 6 $mA/cm^2$.

5. The process of claim 1, wherein the second electrical current ranges from approximately 12 $mA/cm^2$ to approximately 25 $mA/cm^2$.

6. The process of claim 4, wherein the second electrical current ranges from approximately 12 $mA/cm^2$ to approximately 25 $mA/cm^2$.

7. The process of claim 4, wherein the first electrical current is applied to the substrate in pulses ranging from approximately 0.01 second to approximately 10 seconds.

8. The process of claim 5, wherein the second electrical current is applied to the substrate in pulses ranging from approximately 0.01 second to approximately 10 seconds.

9. A multilayered alloy comprising a plurality of alternating layers of nickel and a nickel-manganese alloy.

10. The multilayered alloy of claim 9, wherein each of the alternating layers is of the same thickness.

11. The multilayered alloy of claim 9, wherein each of the alternating layers is of a different thickness.

12. The multilayered alloy of claim 9, wherein each of the alternating layers of nickel and nickel-manganese alloy has a thickness of from approximately 3 Å to approximately 20 nm.

13. The multilayered alloy of claim 12, wherein each of the alternating layers of nickel and nickel-manganese alloy has a thickness of from approximately 2 nm to approximately 5 nm.

14. The multilayered alloy of claim 9, wherein the multilayered alloy has as-plated strength of greater than approximately 900 MPa.

15. The multilayered alloy of claim 9, wherein the multilayered alloy exhibits internal stress of less than approximately 100 MPa.

16. The multilayered alloy of claim 9, wherein the multilayered alloy exhibits greater than approximately 6% total ductility.

17. The multilayered alloy of claim 14, wherein the multilayered alloy retains at least 85% of as-plated strength after heating at 600° C. for 1 hour.

18. The multilayered alloy of claim 9, wherein the multilayered alloy exhibits a variation in compositional uniformity of less than approximately 15%.

19. A micropart fabricated using the method of claim 1.

20. The micropart of claim 19, wherein the combined height of the adjacent layers of nickel and a nickel-manganese alloy ranges from approximately 200 $\mu$m to approximately 2 mm.

21. The micropart of claim 19, wherein the micropart comprises features having an aspect ratio of greater than approximately 10.

* * * * *